US010808996B2

(12) United States Patent
Jung

(10) Patent No.: US 10,808,996 B2
(45) Date of Patent: Oct. 20, 2020

(54) VESSEL COMPRISING ENGINE

(71) Applicant: DAEWOO SHIPBUILDING & MARINE ENGINEERING CO., LTD., Seoul (KR)

(72) Inventor: Hae Won Jung, Seoul (KR)

(73) Assignee: DAEWOOD SHIPBUILDING & MARINE ENGINEERING CO., LTD., Seoul (KR)

( * ) Notice: Subject to any disclaimer, the term of this patent is extended or adjusted under 35 U.S.C. 154(b) by 146 days.

(21) Appl. No.: 16/061,335

(22) PCT Filed: Jun. 29, 2016

(86) PCT No.: PCT/KR2016/006969
§ 371 (c)(1),
(2) Date: Jun. 11, 2018

(87) PCT Pub. No.: WO2017/099316
PCT Pub. Date: Jun. 15, 2017

(65) Prior Publication Data

US 2019/0041125 A1 Feb. 7, 2019

(30) Foreign Application Priority Data

Dec. 9, 2015 (KR) ..... 10-2015-0175094

(51) Int. Cl.
*F25J 1/00* (2006.01)
*B63H 21/38* (2006.01)
(Continued)

(52) U.S. Cl.
CPC ..... *F25J 1/0025* (2013.01); *B63B 25/14* (2013.01); *B63B 25/16* (2013.01); *B63H 21/38* (2013.01);
(Continued)

(58) Field of Classification Search
CPC ..... F25J 1/0025; F25J 1/0202; F25J 1/004; F25J 1/023; F25J 1/0264; F25J 1/0045;
(Continued)

(56) References Cited

U.S. PATENT DOCUMENTS 2,959,020 A * 11/1960 Knapp ..... F25J 1/004 62/613
3,885,394 A * 5/1975 Witt ..... B63H 21/00 60/651
(Continued)

FOREIGN PATENT DOCUMENTS

EP 3323707 A1 5/2018
KR 10-1310025 B1 9/2013
(Continued)

OTHER PUBLICATIONS

International Search Report of PCT/KR2016/006969 which is the parent application and its English translation—6 pages, (dated Sep. 30, 2016).
(Continued)

*Primary Examiner* — Nelson J Nieves
(74) *Attorney, Agent, or Firm* — Knobbe Martens Olson & Bear LLP

(57) ABSTRACT

A vessel includes an engine; a first self-heat exchanger for heat-exchanging boil-off gas discharged from a storage tank; a multi-stage compressor for compressing, in multi-stages, the boil-off gas, which has passed through the first self-heat exchanger after being discharged from the storage tank; a first decompressor for expanding a portion of the boil-off gas, which has passed through the first self-heat exchanger after being compressed by the multi-stage compressor; a second decompressor for expanding the other portion of the boil-off gas, which has passed through the first self-heat exchanger after being compressed by the multi-stage compressor; and a second self-heat exchanger for heat-exchang-
(Continued)

ing and cooling the portion of the boil-off gas, which has been compressed by the multi-stage compressor, by using, as a refrigerant, a fluid which has been expanded by the first decompressor.

8 Claims, 7 Drawing Sheets

(51) Int. Cl.

| | |
|---|---|
| ***F17C 6/00*** | (2006.01) |
| ***B63B 25/16*** | (2006.01) |
| ***F17C 9/00*** | (2006.01) |
| ***F25J 1/02*** | (2006.01) |
| ***B63B 25/14*** | (2006.01) |
| ***B63J 2/14*** | (2006.01) |

(52) U.S. Cl.
CPC ..... *B63J 2/14* (2013.01); *F17C 6/00* (2013.01); *F17C 9/00* (2013.01); *F25J 1/004* (2013.01); *F25J 1/0045* (2013.01); *F25J 1/0092* (2013.01); *F25J 1/0202* (2013.01); *F25J 1/023* (2013.01); *F25J 1/0264* (2013.01); *F25J 1/0277* (2013.01); *F17C 2221/033* (2013.01); *F17C 2223/0161* (2013.01); *F17C 2223/033* (2013.01); *F17C 2225/0161* (2013.01); *F17C 2225/033* (2013.01); *F17C 2227/0157* (2013.01); *F17C 2227/0306* (2013.01); *F17C 2227/036* (2013.01); *F17C 2227/0339* (2013.01); *F17C 2227/0388* (2013.01); *F17C 2265/033* (2013.01); *F17C 2265/034* (2013.01); *F17C 2265/037* (2013.01); *F17C 2265/038* (2013.01); *F17C 2265/066* (2013.01); *F17C 2270/0105* (2013.01); *F25J 2210/06* (2013.01)

(58) Field of Classification Search
CPC . F25J 1/0277; F25J 1/0092; B63J 2/14; F17C 6/00; F17C 2225/0161; F17C 2225/033; F17C 2227/0306; F17C 2227/0388; F17C 2227/036; F17C 2227/0339; F17C 2227/0157; F17C 2265/038; F17C 2265/034; F17C 2265/066; F17C 2265/037; F17C 2265/033; B63H 21/38
See application file for complete search history.

(56) References Cited

U.S. PATENT DOCUMENTS

| | | | | |
|---|---|---|---|---|
| 5,036,671 | A * | 8/1991 | Nelson | F25J 1/0022 62/48.2 |
| 6,742,357 | B1 * | 6/2004 | Roberts | C09K 5/042 62/612 |
| 9,528,759 | B2 * | 12/2016 | Ransbarger | F25J 1/0022 |
| 2014/0250922 | A1 * | 9/2014 | Kang | F02M 21/0215 62/50.2 |
| 2014/0290279 | A1 * | 10/2014 | Lee | B63B 25/16 62/48.2 |
| 2015/0253073 | A1 * | 9/2015 | Lee | F25J 1/0025 62/48.2 |
| 2017/0114960 | A1 * | 4/2017 | Lee | F25J 1/004 |

FOREIGN PATENT DOCUMENTS

| | | | |
|---|---|---|---|
| KR | 10-1356003 | B1 | 2/2014 |
| KR | 10-2014-0052896 | A | 5/2014 |
| KR | 10-1441243 | B1 | 9/2014 |
| KR | 10-2015-0039427 | A | 4/2015 |
| KR | 10-2015-0089353 | A | 8/2015 |
| KR | 10-2015-0093003 | A | 8/2015 |

OTHER PUBLICATIONS

Office Action of corresponding Korean Patent Application No. 10-2015-0175094—5 pages, (dated Feb. 7, 2017).
Office Action of corresponding Korean Patent Application No. 10-2015-0175091—5 pages, (dated Feb. 7, 2017).
Extended European Search Report of corresponding Patent Application No. 16873182.6—9 pages. (dated Jul. 4, 2019).

* cited by examiner

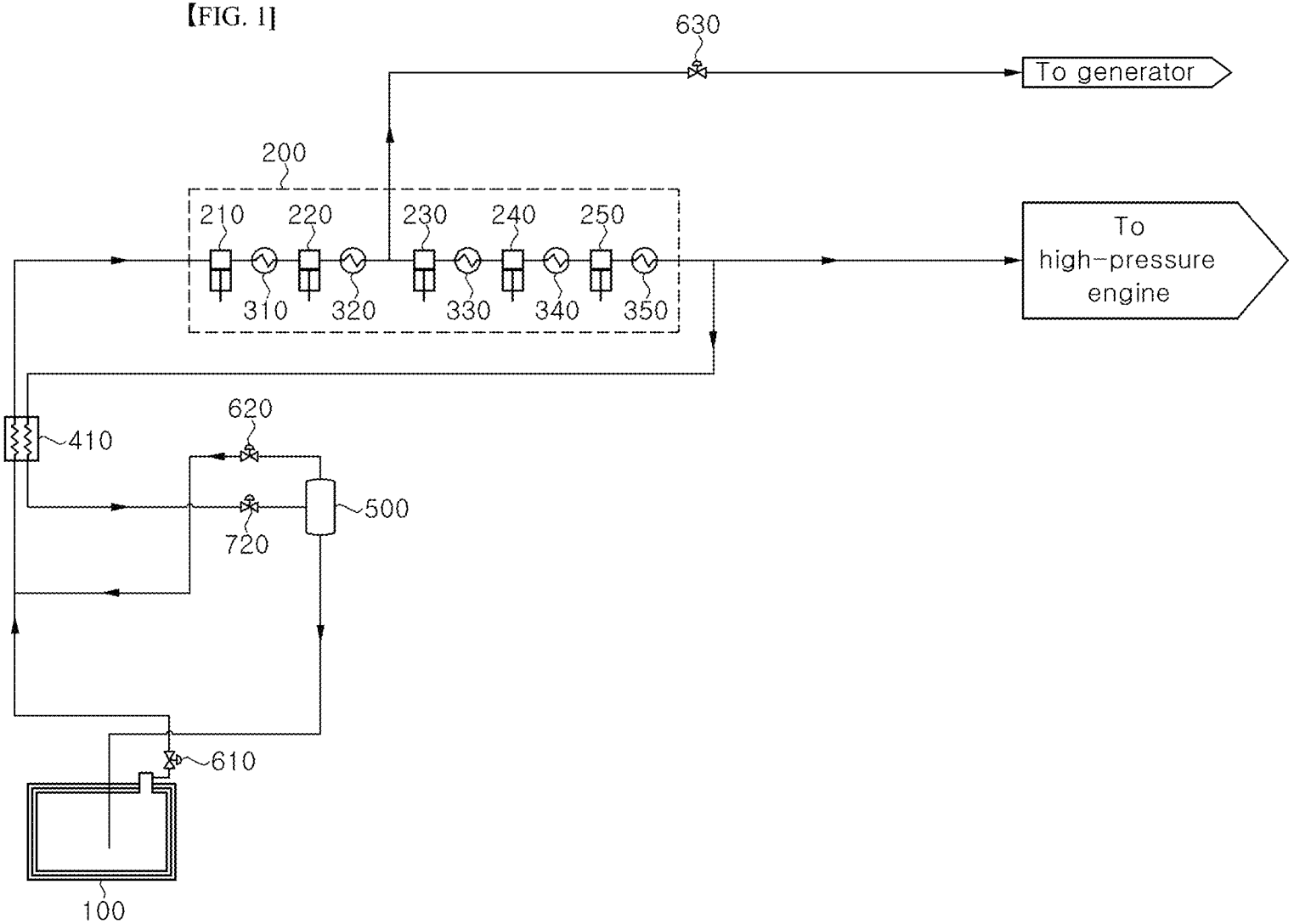
【FIG. 1】

[FIG. 2]
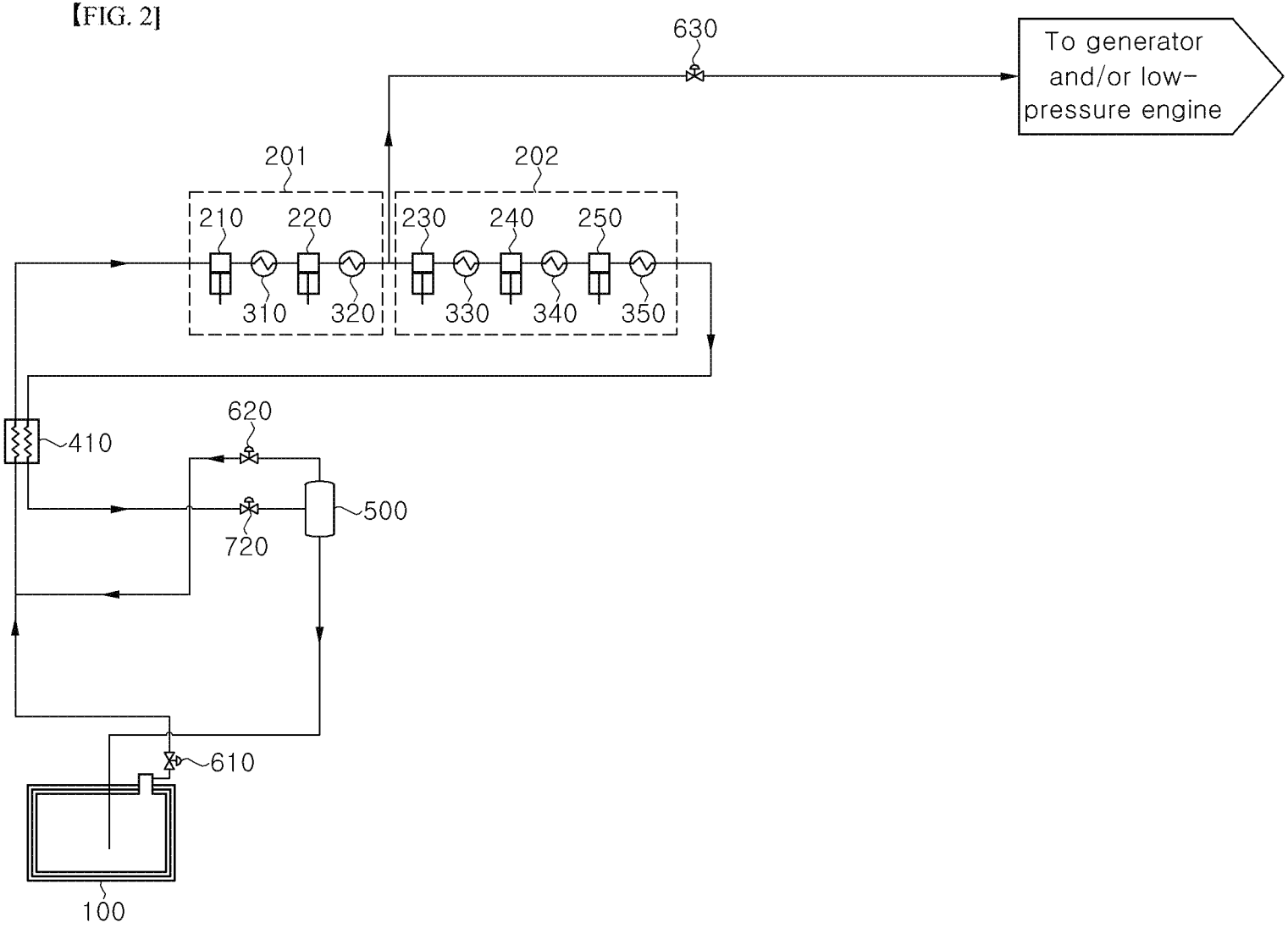

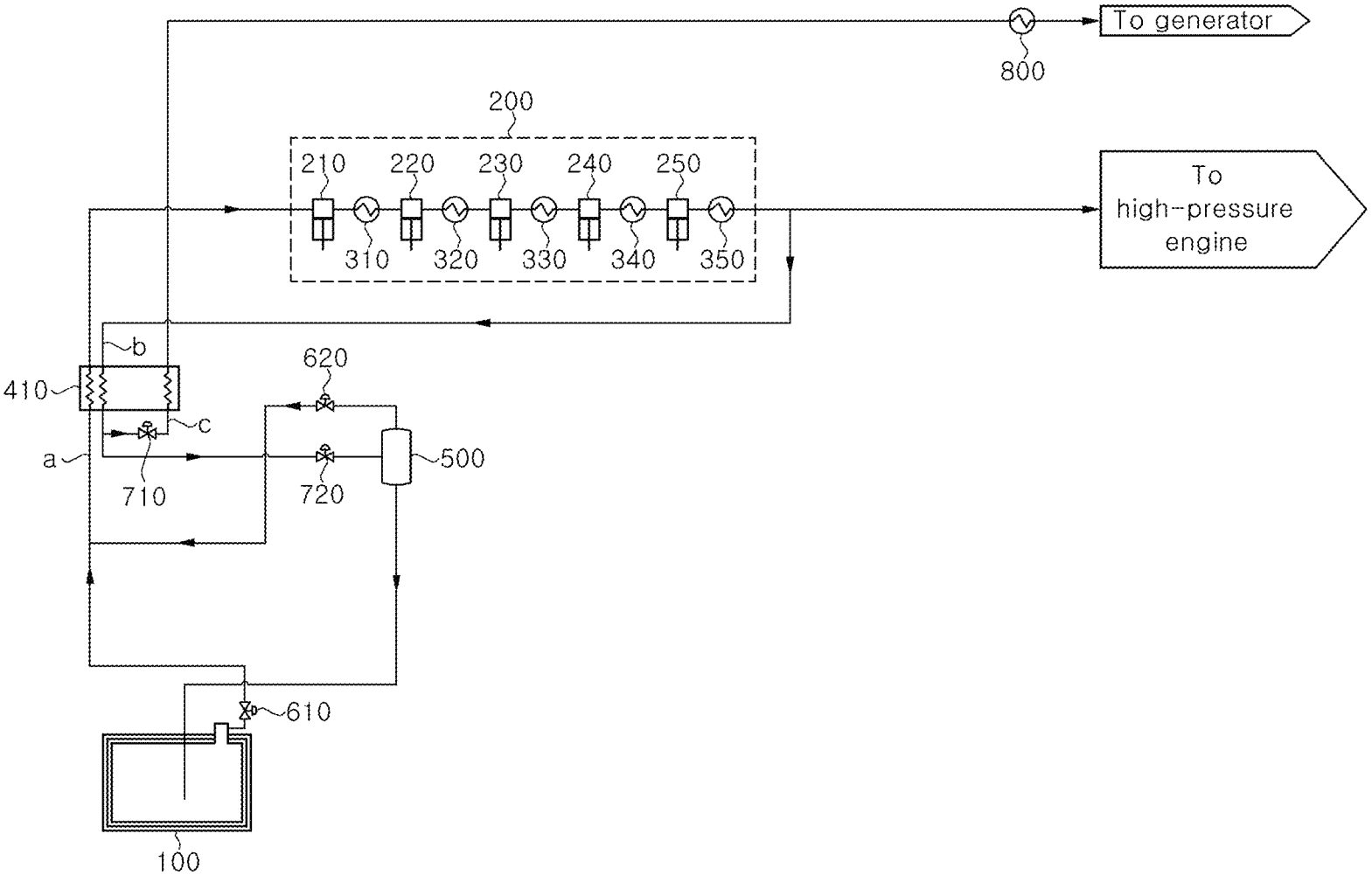
[FIG. 3]

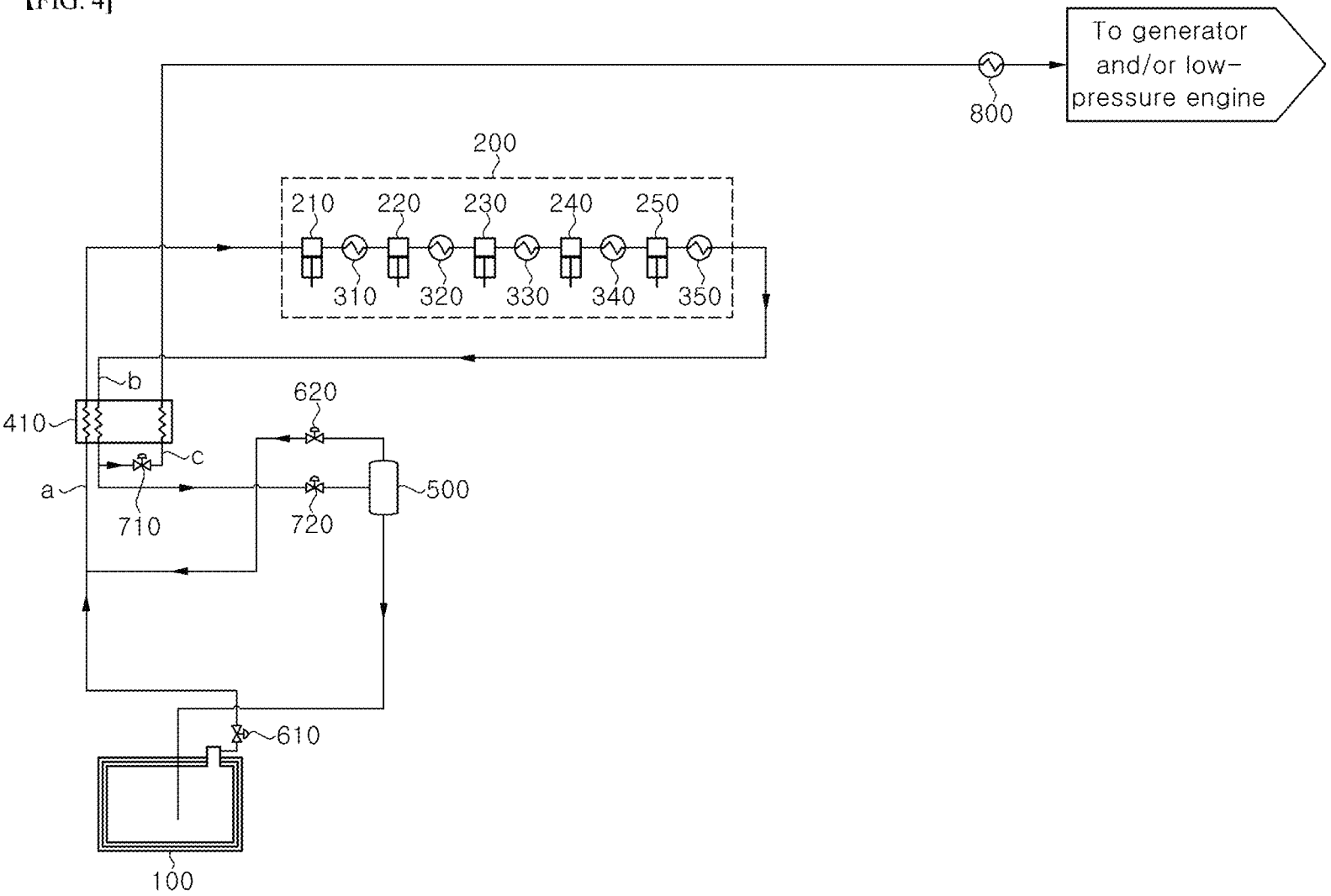
[FIG. 4]

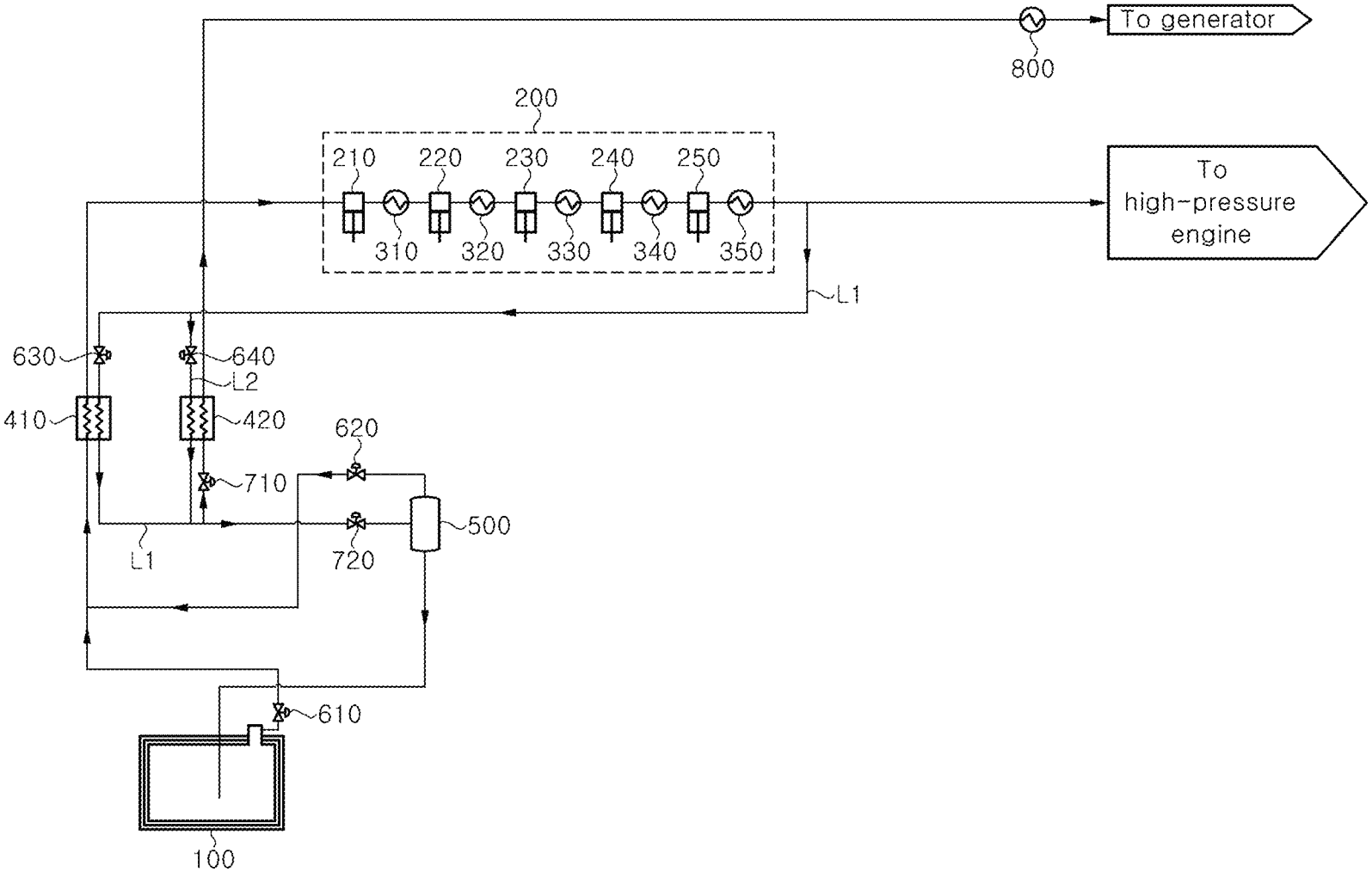
[FIG. 5]

[FIG. 6]
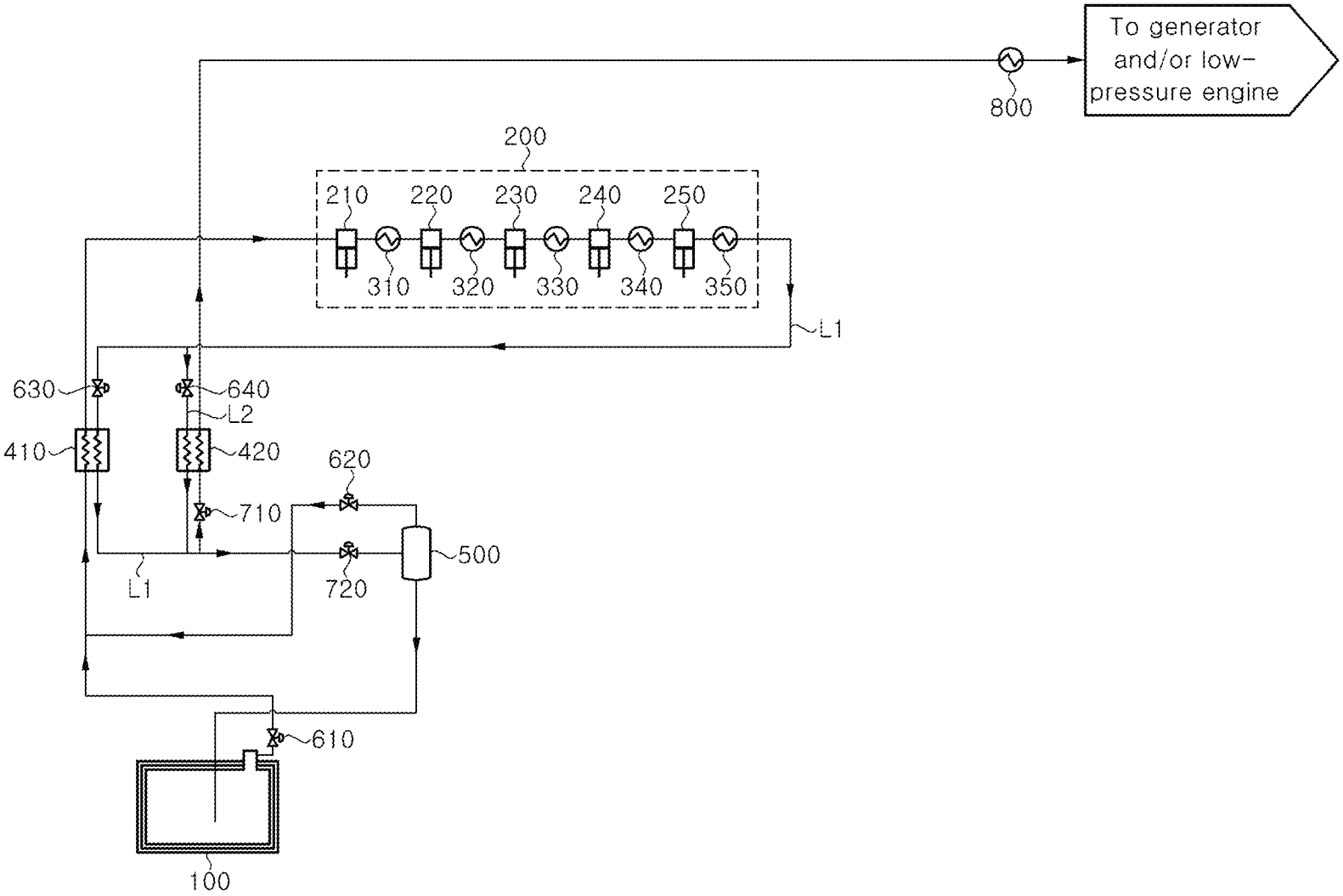

【FIG. 7】
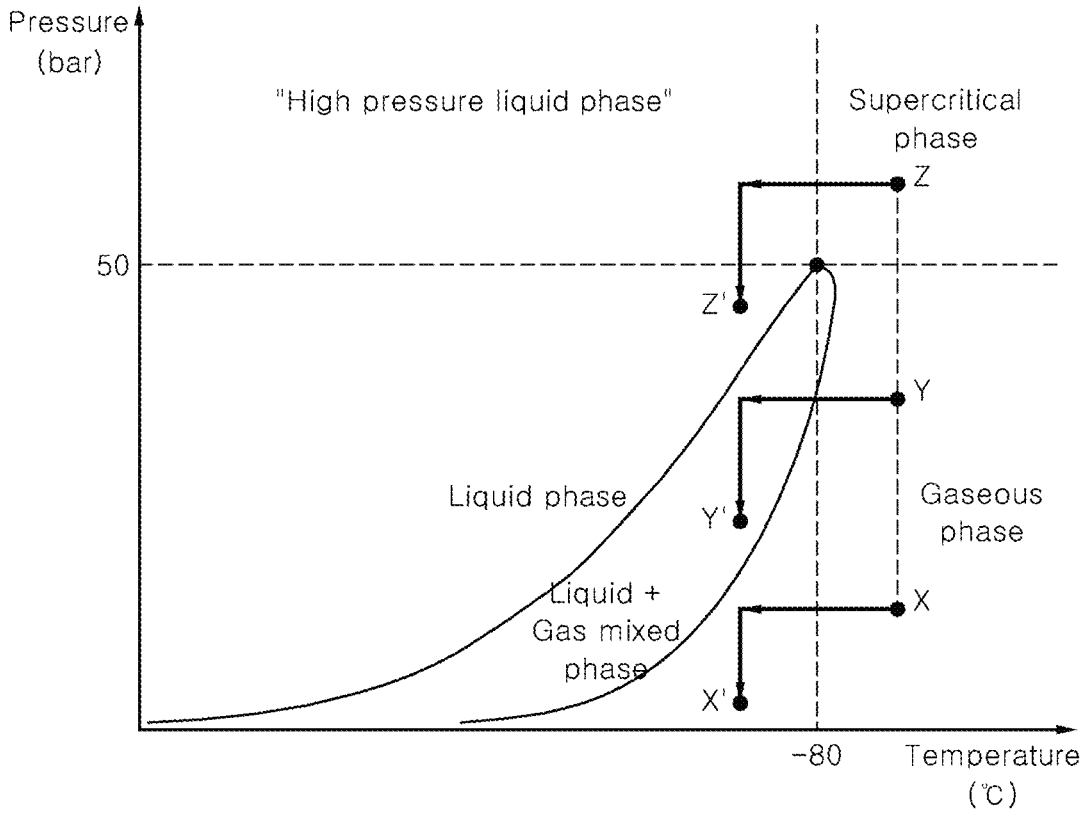

VESSEL COMPRISING ENGINE

TECHNICAL FIELD

The present invention relates to a ship including an engine and, more particularly, to a ship including an engine, in which boil-off gas (BOG) remaining after being used as fuel in the engine is reliquefied into liquefied natural gas using boil-off gas as a refrigerant and is returned to a storage tank.

BACKGROUND ART

Generally, natural gas is liquefied and transported over a long distance in the form of liquefied natural gas (LNG). Liquefied natural gas is obtained by cooling natural gas to a very low temperature of about −163° C. at atmospheric pressure and is well suited to long-distance transportation by sea, since the volume thereof is significantly reduced, as compared with natural gas in a gas phase.

Even when an LNG storage tank is insulated, there is a limit to completely block external heat. Thus, LNG is continuously vaporized in the LNG storage tank by heat transferred into the storage tank. LNG vaporized in the storage tank is referred to as boil-off gas (BOG).

If the pressure in the storage tank exceeds a predetermined safe pressure due to generation of boil-off gas, the boil-off gas is discharged from the storage tank through a safety valve. The boil-off gas discharged from the storage tank is used as fuel for a ship or is reliquefied and returned to the storage tank.

Examples of an engine capable of being fueled by natural gas include a dual fuel (DF) engine and an ME-GI engine.

The DF engine uses an Otto cycle consisting of four strokes, in which natural gas at a relatively low pressure of about 6.5 bar is injected into a combustion air inlet and then compressed by a piston moving upward.

The ME-GI engine uses a diesel cycle consisting of two strokes, in which natural gas at a high pressure of about 300 bar is injected directly into a combustion chamber near the top dead point of a piston. Recently, there is growing interest in the ME-GI engine, which has better fuel efficiency and propulsion efficiency.

DISCLOSURE

Technical Problem

Typically, a boil-off gas (BOG) reliquefaction system employs a cooling cycle for reliquefaction of BOG through cooling. Cooling of BOG is performed through heat exchange with a refrigerant and a partial reliquefaction system (PRS) using BOG itself as a refrigerant is used in the art.

FIG. 1 is a schematic diagram of a partial reliquefaction system applied to a ship including a high-pressure engine in the related art.

Referring to FIG. 1, in a partial reliquefaction system applied to a ship including a high-pressure engine in the related art, BOG discharged from a storage tank 100 is sent to a self-heat exchanger 410 via a first valve 610. The BOG discharged from the storage tank 100 and subjected to heat exchange with a refrigerant in the self-heat exchanger 410 is subjected to multistage compression by a multistage compressor 200, which includes a plurality of compression cylinders 210, 220, 230, 240, 250 and a plurality of coolers 310, 320, 330, 340, 350. Then, some BOG is sent to a high-pressure engine to be used as fuel and the remaining BOG is sent to the self-heat exchanger 410 to be cooled through heat exchange with BOG discharged from the storage tank 100.

The BOG cooled by the self-heat exchanger 410 after multiple stages of compression is partially reliquefied by a decompressor 720 and is separated into liquefied natural gas generated through reliquefaction and gaseous BOG by a gas/liquid separator 500. The reliquefied natural gas separated by the gas/liquid separator 500 is sent to the storage tank 100, and the gaseous BOG separated by the gas/liquid separator 500 is joined with BOG discharged from the storage tank 100 after passing through a second valve 620 and is then sent to the self-heat exchanger 410.

On the other hand, some of the BOG discharged from the storage tank 100 and having passed through the self-heat exchanger 410 is subjected to a partial compression process among multistage compression (for example, passes through two compression cylinders 210, 220 and two coolers 310, 320 among five compression cylinders 210, 220, 230, 240, 250 and five coolers 310, 320, 330, 340, 350), divided to a third valve 630, and finally sent to a generator. Since the generator requires natural gas having a lower pressure than pressure required for the high-pressure engine, the BOG subjected to the partial compression process is supplied to the generator FIG. 2 is a schematic block diagram of a typical partial reliquefaction system used in a ship including a low-pressure engine.

Referring to FIG. 2, as in the partial reliquefaction system applied to a ship including a high-pressure engine, in a partial reliquefaction system applied to a ship including a low-pressure engine in the related art, BOG discharged from a storage tank 100 is sent to a self-heat exchanger 410 via a first valve 610. As in the partial reliquefaction system shown in FIG. 1, the BOG having been discharged from the storage tank 100 and passed through the self-heat exchanger 410 is subjected to multistage compression by multistage compressors 201, 202 and is then sent to the self-heat exchanger 410 to be cooled through heat exchange with BOG discharged from the storage tank 100.

As in the partial reliquefaction system shown in FIG. 1, the BOG cooled by the self-heat exchanger 410 after multiple stages of compression is partially reliquefied by a decompressor 720 and is separated into liquefied natural gas generated through reliquefaction and gaseous BOG by a gas/liquid separator 500. The reliquefied natural gas separated by the gas/liquid separator 500 is sent to the storage tank 100, and the gaseous BOG separated by the gas/liquid separator 500 is joined with BOG discharged from the storage tank 100 after passing through a second valve 620 and is then sent to the self-heat exchanger 410.

Here, unlike the partial reliquefaction system shown in FIG. 1, in the partial reliquefaction system applied to a ship including a low-pressure engine in the related art, the BOG subjected to the partial compression process among the multiple stages of compression is divided and sent to the generator and the engine and all of the BOG subjected to all of the multiple stages of compression is sent to the self-heat exchanger 410. Since the low-pressure engine requires natural gas having a similar pressure to pressure required for the generator, the BOG subjected to the partial compression process is supplied to the low-pressure engine and the generator.

In the partial reliquefaction system applied to the ship including the high-pressure engine in the related art, since some of the BOG subjected to all of the multiple stages of compression is sent to the high-pressure engine, a single multistage compressor 200 having capacity required for the high-pressure engine is installed.

However, in the partial reliquefaction system applied to the ship including the low-pressure engine in the related art, since the BOG subjected to the partial compression process among the multiple stages of compression is sent to the generator and the engine and the BOG subjected to all of the multiple stages of compression is not sent to the engine, none of the compression stages require a large capacity compression cylinder.

Accordingly, some of BOG compressed by a first multistage compressor 201 having a relatively large capacity is divided and sent to the generator and the engine, and the remaining BOG is additionally compressed by a second multistage compressor 201 having a relatively small capacity and sent to the self-heat exchanger 410.

In the partial reliquefaction system applied to the ship including the low-pressure engine in the related art, the capacity of the compressor is optimized depending upon the degree of compression required for the generator or the engine in order to prevent increase in manufacturing cost associated with the capacity of the compressor, and installation of two multistage compressors 201, 202 provides a drawback of troublesome maintenance and overhaul.

Embodiments of the present invention provide a ship comprising an engine, which uses BOG to be sent to a generator as a refrigerant for heat exchange based on the fact that some BOG having a relatively low temperature and pressure is divided and sent to the generator (to the generator and the engine in the case of a low-pressure engine).

Technical Solution

In accordance with one aspect of the present invention, a ship including an engine includes: a first self-heat exchanger performing heat exchange with respect to boil-off gas (BOG) discharged from a storage tank; a multistage compressor compressing the BOG discharged from the storage tank and having passed through the first self-heat exchanger in multiple stages; a first decompressor expanding some of the BOG having passed through the first self-heat exchanger after compression by the multistage compressor; a second decompressor expanding the other BOG having passed through the first self-heat exchanger after compression by the multistage compressor; and a second self-heat exchanger cooling some of the BOG compressed by the multistage compressor through heat exchange using the fluid expanded by the first decompressor as a refrigerant, wherein the first self-heat exchanger cools the other BOG compressed by the multistage compressor using the BOG discharged from the storage tank as a refrigerant.

The BOG having passed through the second decompressor may be sent to the storage tank.

The ship may further include a gas/liquid separator disposed downstream of the second decompressor and separating liquefied natural gas generated through reliquefaction of the BOG and gaseous BOG from each other, wherein the liquefied natural gas separated by the second gas/liquid separator is sent to the storage tank and the gaseous BOG separated by the second gas/liquid separator is sent to the first self-heat exchanger.

Some of the BOG having passed through the multistage compressor may be sent to a high-pressure engine.

The BOG having passed through the first decompressor and the second self-heat exchanger may be sent to at least one of a generator and a low-pressure engine.

The ship may further include a heater disposed on a line along which the BOG having passed through the first decompressor and the second self-heat exchanger is sent to the generator, when the BOG having passed through the first decompressor and the second self-heat exchanger is sent to the generator.

In accordance with another aspect of the present invention, a method includes: 1) performing multistage compression with respect to boil-off gas (BOG) discharged from a storage tank; 2) cooling some of the BOG subjected to multistage compression through heat exchange with BOG discharged from the storage tank; 3) cooling the other BOG subjected to multistage compression through heat exchange with a fluid expanded by a first decompressor, 4) joining the fluid cooled in step 2) with the fluid cooled in step 3), and 5) using some of the fluid joined in step 4) as a refrigerant in step 3) after expansion by the first decompressor while reliquefying the other fluid joined in step 4) through expansion.

The method may further include: 6) separating gaseous BOG and liquefied natural gas generated through partial reliquefaction of the BOG expanded in step 5) from each other, and 7) sending the liquefied natural gas separated in step 6) to the storage tank and joining the gaseous BOG gas separated in step 6) with the BOG discharged from the storage tank to be used as a refrigerant for heat exchange in step 2).

Some of the BOG subjected to multistage compression in step 1) may be sent to a high-pressure engine.

The fluid expanded by the first decompressor and having been used as a refrigerant for heat exchange may be sent to at least one of a generator and a low-pressure engine.

Advantageous Effects

According to embodiments of the invention, the ship including an engine uses not only BOG discharged from the storage tank but also BOG sent to a generator as a refrigerant in a self-heat exchanger, thereby improving reliquefaction efficiency, and allows easy maintenance and overhaul by providing one multistage compressor even in a structure wherein the ship includes a low-pressure engine.

DESCRIPTION OF DRAWINGS

FIG. 1 is a schematic diagram of a partial reliquefaction system applied to a ship including a high-pressure engine in the related art.

FIG. 2 is a schematic diagram of a partial reliquefaction system applied to a ship including a low-pressure engine in the related art.

FIG. 3 is a schematic diagram of a partial reliquefaction system applied to a ship including a high-pressure engine according to a first embodiment of the present invention.

FIG. 4 is a schematic diagram of the partial reliquefaction system applied to a ship including a low-pressure engine according to the first embodiment of the present invention.

FIG. 5 is a schematic diagram of a partial reliquefaction system applied to a ship including a high-pressure engine according to a second embodiment of the present invention.

FIG. 6 is a schematic diagram of the partial reliquefaction system applied to a ship including a low-pressure engine according to the second embodiment of the present invention.

FIG. 7 is a graph depicting a phase transformation curve of methane depending upon temperature and pressure.

BEST MODE

Hereinafter, embodiments of the present invention will be described with reference to the accompanying drawings. A ship including an engine according to the present invention may be applied to various marine and overland systems. Although liquefied natural gas is used by way of example in the following embodiments, it should be understood that the present invention is not limited thereto and may be applied to various liquefied gases. It should be understood that the following embodiments can be modified in various ways and do not limit the scope of the present invention.

In the following embodiments, a fluid flowing through each flow path may be in a gaseous state, a gas-liquid mixed state, a liquid state, or a supercritical fluid state depending on system operating conditions.

FIG. 3 is a schematic diagram of a partial reliquefaction system applied to a ship including a high-pressure engine according to a first embodiment of the present invention.

Referring to FIG. 3, the ship according to this embodiment includes: a self-heat exchanger 410 performing heat exchange with respect to BOG discharged from a storage tank 100; a multistage compressor 200 compressing the BOG discharged from the storage tank 100 and having passed through the self-heat exchanger 410 in multiple stages; a first decompressor 710 expanding some of the BOG compressed by the multistage compressor 200 and having passed through the self-heat exchanger 410; and a second decompressor 720 expanding the other BOG compressed by the multistage compressor 200 and having passed through the self-heat exchanger 410.

In this embodiment, the self-heat exchanger 410 performs heat exchange between the BOG discharged from the storage tank 100 (flow a in FIG. 3), the BOG compressed by the multistage compressor 200 (flow b in FIG. 3), and the BOG expanded by the first decompressor 710 (flow c in FIG. 3). Specifically, the self-heat exchanger 410 cools the BOG compressed by the multistage compressor 200 (flow b in FIG. 3) using the BOG discharged from the storage tank 100 (flow a in FIG. 3) and the BOG expanded by the first decompressor 710 (flow c in FIG. 3) as a refrigerant. In the term "self-heat exchanger", "self-" means that cold BOG is used as a refrigerant for heat exchange with hot BOG.

In the ship according to this embodiment, the BOG having passed through the first decompressor 710 is used as a refrigerant for additional heat exchange in the self-heat exchanger 410, thereby improving reliquefaction efficiency.

According to this embodiment, the BOG discharged from the storage tank 100 is generally used in three ways. That is, the BOG discharged from the storage tank 100 is used as fuel for the engine after being compressed to a critical pressure or more, sent to a generator after being compressed to a relatively low pressure less than or equal to the critical pressure, or reliquefied and returned to the storage tank 100 when remaining after fulfilling the amount of BOG required for the engine and the generator.

According to this embodiment, the BOG expanded by the first decompressor 710 is sent again to the self-heat exchanger 410 to be used as a refrigerant for heat exchange and then sent to the generator, based on the fact that the BOG to be sent to the generator is decreased not only in pressure and but also in temperature upon expansion.

The multistage compressor 200 performs multistage compression with respect to BOG discharged from the storage tank 100 and having passed through the self-heat exchanger 410. The multistage compressor 200 includes a plurality of compression cylinders 210, 220, 230, 240, 250 configured to compress BOG, and a plurality of coolers 310, 320, 330, 340, 350 disposed downstream of the plurality of compression cylinders 210, 220, 230, 240, 250, respectively, and configured to cool the BOG compressed by the compression cylinders 210, 220, 230, 240, 250 and having increased pressure and temperature. In this embodiment, the multistage compressor 200 includes five compression cylinders 210, 220, 230, 240, 250 and five coolers 310, 320, 330, 340, 350, and the BOG is subjected to five stages of compression while passing through the multistage compressor 200. However, it should be understood that this embodiment is provided for illustration only and the present invention is not limited thereto.

FIG. 7 is a graph depicting a phase transformation curve of methane depending upon temperature and pressure. Referring to FIG. 7, methane has a supercritical fluid phase under conditions of about −80° C. or more and a pressure of about 50 bar or more. That is, methane has a critical point at −80° and 50 bar. The supercritical fluid phase is a third phase different from a liquid phase or a gas phase. Here, the critical point of methane can be changed depending upon the amount of nitrogen contained in boil-off gas.

On the other hand, although a fluid having a temperature less than a critical temperature at a critical pressure or more can have a phase different from a general liquid and similar to a supercritical fluid having a high density, and thus can be generally referred to as the supercritical fluid, the phase of boil-off gas having a critical pressure or more and a critical temperature or less will be referred to as "high-pressure liquid phase" hereinafter.

Referring to FIG. 7, it can be seen that, although the gas phase of natural gas having a relatively low pressure (X in FIG. 7) is kept even after reduction in temperature and pressure (X' in FIG. 7), the natural gas can become a gas-liquid mixed phase (Y' in FIG. 7) due to partial liquefaction even upon reduction in temperature and pressure after the pressure of the natural gas is raised (Y in FIG. 7). That is, it can be seen that liquefaction efficiency can further increase with increasing pressure of the natural gas before the natural gas passes through the self-heat exchanger 410 and theoretically 100% liquefaction can also be achieved (Z→Z' in FIG. 7) if the pressure can be sufficiently raised.

Accordingly, the multistage compressor 200 according to this embodiment compresses the BOG discharged from the storage tank 100 so as to reliquefy the BOG.

According to this embodiment, the first decompressor 710 expands some BOG subjected to multistage compression in the multistage compressor 200 and having passed through the self-heat exchanger 410 (flow c in FIG. 3). The first decompressor 710 may be an expansion device or an expansion valve.

According to this embodiment, the second decompressor 720 expands the other BOG subjected to multistage compression in the multistage compressor 200 and having passed through the self-heat exchanger 410. The second decompressor 720 may be an expansion device or an expansion valve.

The ship according to this embodiment may further include a gas/liquid separator 500 that separates gaseous BOG and liquefied natural gas generated by partial reliquefaction of the BOG through cooling by the self-heat exchanger 410 and expansion by the second decompressor 720. The liquefied natural gas separated by the gas/liquid separator 500 may be sent to the storage tank 100 and the gaseous BOG separated by the gas/liquid separator 500 may be sent to the line along which the BOG is sent from the storage tank 100 to the self-heat exchanger 410.

The ship according to this embodiment may further include at least one of a first valve 610 blocking the BOG discharged from the storage tank 100 as needed and a heater 800 heating the BOG sent to the generator through the first decompressor 710 and the self-heat exchanger 410 (flow c in FIG. 3). The first valve 610 may be normally maintained in an open state and may be closed upon maintenance or overhaul of the storage tank 100.

In the structure wherein the ship includes the gas/liquid separator 500, the ship may further include a second valve 620 that controls the flow amount of the gaseous BOG separated by the gas/liquid separator 500 and sent to the self-heat exchanger 410.

The flow of fluid according to this embodiment will be described hereinafter. It should be noted that temperature and pressure of BOG described hereinafter are approximate theoretical values and can be changed depending upon the temperature of the BOG, the pressure required for the engine, design of the multistage compressor, the speed of the ship, and the like.

BOG generated due to intrusion of external heat inside the storage tank 100 and having a temperature of about −130° C. to −80° C. and atmospheric pressure is discharged from the storage tank 100 and sent to the self-heat exchanger 410 when the pressure of the BOG reaches a predetermined pressure or more.

The BOG discharged from the storage tank 100 and having a temperature of about −130° C. to −80° C. may be mixed with BOG separated by the gas/liquid separator 500 and having a temperature of about −160° C. to −110° C. and atmospheric pressure, and then sent to the self-heat exchanger 410 in a state that the BOG has a temperature of about −140° C. to −100° C. and atmospheric pressure.

The BOG sent from the storage tank 100 to the self-heat exchanger 410 (flow a in FIG. 3) can have a temperature of about −90° C. to 40° C. and atmospheric pressure through heat exchange with BOG having passed through the multistage compressor 200 and having a temperature of about 40° C. to 50° C. and a pressure of about 150 to 400 bar (flow b in FIG. 3) and BOG having passed through the first decompressor 710 and having a temperature of about −140° C. to −110° C. and a pressure of about 6 to 10 bar (flow c in FIG. 3). The BOG discharged from storage tank 100 (flow a in FIG. 3) is compressed together with the BOG having passed through the first decompressor 710 (flow c in FIG. 3) by the multistage compressor 200 and is used as a refrigerant for cooling the BOG sent to the self-heat exchanger 410 (flow b in FIG. 3).

The BOG discharged from the storage tank 100 and having passed through the self-heat exchanger 410 is subjected to multistage compression by the multistage compressor 200. According to this embodiment, since some of the BOG having passed through the multistage compressor 200 is used as fuel of a high-pressure engine, the BOG is compressed by the multistage compressor 200 to have a pressure required for the high-pressure engine. When the high-pressure engine is an ME-GI engine, the BOG having passed through the multistage compressor 200 has a temperature of about 40° C. to 50° C. and a pressure of about 150 to 400 bar.

Among the BOG compressed to the critical pressure or more through multistage compression by the multistage compressor 200, some BOG is used as fuel of the high-pressure engine and the other BOG is sent to the self-heat exchanger 410. The BOG compressed by the multistage compressor 200 and having passed through the self-heat exchanger 410 may have a temperature of about −130° C. to −90° C. and a pressure of about 150 to 400 bar.

The BOG compressed by the multistage compressor 200 and having passed through the self-heat exchanger 410 (flow b in FIG. 3) is divided into two flows, one of which is expanded by the first decompressor 710 and the other of which is expanded by the second decompressor 720.

The BOG expanded by the first decompressor 710 after passing through the self-heat exchanger 410 (flow c in FIG. 3) is sent again to the self-heat exchanger 410 to be used as a refrigerant for cooling the BOG having passed through the multistage compressor 200 (flow b in FIG. 3) through heat exchange and is then sent to the generator.

The BOG expanded by the first decompressor 710 after passing through the self-heat exchanger 410 may have a temperature of about −140° C. to −110° C. and a pressure of about 6 to 10 bar. Since the BOG expanded by the first decompressor 710 is sent to the generator, the BOG is expanded to a pressure of about 6 to 10 bar, which is a pressure required for the generator. In addition, the BOG having passed through the first decompressor 710 may have a gas-liquid mixed phase.

The BOG having passed through the self-heat exchanger 410 after being expanded by the first decompressor 710 may have a temperature of about −90° C. to 40° C. and a pressure of about 6 to 10 bar, and the BOG having passed through the first decompressor 710 may become a gas phase through heat exchange in the self-heat exchanger 410.

The BOG sent to the generator after having passed through the first decompressor 710 and the self-heat exchanger 410 may be controlled to a temperature required for the generator by the heater 800 disposed upstream of the generator. The BOG having passed through the heater 800 may have a gas phase having a temperature of about 40° C. to 50° C. and a pressure of about 6 to 10 bar.

The BOG expanded by the second decompressor 720 after having passed through the self-heat exchanger 410 may have a temperature of about −140° C. to −110° C. and a pressure of about 2 to 10 bar. In addition, the BOG having passed through the second decompressor 720 is partially reliquefied. The BOG partially reliquefied in the second decompressor 720 may be sent in a gas-liquid mixed phase to the storage tank 100 or may be sent to the gas/liquid separator 500, by which the gas-liquid mixed phase is separated into a liquid phase and a gas phase.

When the partially reliquefied BOG is sent to the gas/liquid separator 500, the liquefied natural gas separated by the gas/liquid separator 500 and having a temperature of about −163° C. and atmospheric pressure is sent to the storage tank 100, and the gaseous BOG separated by the gas/liquid separator 500 and having a temperature of about −160° C. to −110° C. and atmospheric pressure is sent together with the BOG discharged from the storage tank 100 to the self-heat exchanger 410. The flow amount of the BOG separated by the gas/liquid separator 500 and sent to the self-heat exchanger 410 may be controlled by the second valve 620.

FIG. 4 is a schematic diagram of the partial reliquefaction system applied to a ship including a low-pressure engine according to the first embodiment of the present invention.

The partial reliquefaction system applied to the ship including the low-pressure engine shown in FIG. 4 is different from the partial reliquefaction system applied to the ship including the high-pressure engine shown in FIG. 3 in that some BOG subjected to multistage compression by the multistage compressor 200 is sent to the generator and/or the engine after having passed through the first decompressor 710 and the self-heat exchanger 410, and the following description will focus on different configuration of the partial reliquefaction system according to this embodiment. Descriptions of details of the same components as those of the ship including the high-pressure engine described above will be omitted.

Differentiation between the high-pressure engine included in the ship to which the partial reliquefaction system shown in FIG. 3 is applied and the low-pressure engine included in the ship to which the partial reliquefaction system shown in FIG. 4 is applied is based on use of natural gas having a critical pressure or more as fuel by the engine. That is, an engine using natural gas having a critical pressure or more as fuel is referred to as the high-pressure engine, and an engine using natural gas having a pressure of less than the critical pressure as fuel is referred to as the low-pressure engine. This standard will be commonly applied hereinafter.

Referring to FIG. 4, as in the ship including the high-pressure engine shown in FIG. 3, the ship according to this embodiment includes a self-heat exchanger 410, a multistage compressor 200, a first decompressor 710, and a second decompressor 720.

As in the ship including the high-pressure engine shown in FIG. 3, the self-heat exchanger 410 according to this embodiment performs heat exchange between BOG discharged from the storage tank 100 (flow a in FIG. 4), BOG compressed by the multistage compressor 200 (flow b in FIG. 4), and BOG expanded by the first decompressor 710 (flow c in FIG. 4). Specifically, the self-heat exchanger 410 cools the BOG compressed by the multistage compressor 200 (flow b in FIG. 4) using the BOG discharged from the storage tank 100 (flow a in FIG. 4) and the BOG expanded by the first decompressor 710 (flow c in FIG. 4) as a refrigerant.

As in the ship including the high-pressure engine shown in FIG. 3, the multistage compressor 200 according to this embodiment performs multistage compression with respect to the BOG discharged from the storage tank 100 and having passed through the self-heat exchanger 410. As in the ship including the high-pressure engine shown in FIG. 3, the multistage compressor 200 according to this embodiment may include a plurality of compression cylinders 210, 220, 230, 240, 250 and a plurality of coolers 310, 320, 330, 340, 350.

As in the ship including the high-pressure engine shown in FIG. 3, the first decompressor 710 according to this embodiment expands some of the BOG subjected to multistage compression in the multistage compressor 200 and having passed through the self-heat exchanger 410 (flow c in FIG. 4). The first decompressor 710 may be an expansion device or an expansion valve.

As in the ship including the high-pressure engine shown in FIG. 3, the second decompressor 720 according to this embodiment expands the other BOG subjected to multistage compression in the multistage compressor 200 and having passed through the self-heat exchanger 410. The second decompressor 720 may be an expansion device or an expansion valve.

As in the ship including the high-pressure engine shown in FIG. 3, the ship according to this embodiment may further include a gas/liquid separator 500 that separates gaseous BOG and liquefied natural gas generated by partial reliquefaction of the BOG through cooling by the self-heat exchanger 410 and expansion by the second decompressor 720. The liquefied natural gas separated by the gas/liquid separator 500 may be sent to the storage tank 100 and the gaseous BOG separated by the gas/liquid separator 500 may be sent to the line along which the BOG is sent from the storage tank 100 to the self-heat exchanger 410.

As in the ship including the high-pressure engine shown in FIG. 3, the ship according to this embodiment may further include at least one of a first valve 610 blocking the BOG discharged from the storage tank 100 as needed; and a heater 800 heating the BOG sent to the generator through the first decompressor 710 and the self-heat exchanger 410 (flow c in FIG. 4).

Further, as in the ship including the high-pressure engine shown in FIG. 3, in the structure wherein the ship includes the gas/liquid separator 500, the ship may further include a second valve 620 that controls the flow amount of the gaseous BOG separated by the gas/liquid separator 500 and sent to the self-heat exchanger 410.

The flow of fluid according to this embodiment will be described hereinafter.

BOG generated due to intrusion of external heat inside the storage tank 100 and having a temperature of about −130° C. to −80° C. and atmospheric pressure is discharged from the storage tank 100 and sent to the self-heat exchanger 410 when the pressure of the BOG reaches a predetermined pressure or more, as in the ship including the high-pressure engine shown in FIG. 3.

The BOG discharged from the storage tank 100 and having a temperature of about −130° C. to −80° C. may be mixed with BOG separated by the gas/liquid separator 500 and having a temperature of about −160° C. to −110° C. and atmospheric pressure, and then sent to the self-heat exchanger 410 in a state that the BOG has a temperature of about −140° C. to −100° C. and atmospheric pressure, as in the ship including the high-pressure engine shown in FIG. 3.

The BOG sent from the storage tank 100 to the self-heat exchanger 410 (flow a in FIG. 4) can have a temperature of about −90° C. to 40° C. and atmospheric pressure through heat exchange with BOG having passed through the multistage compressor 200 and having a temperature of about 40° C. to 50° C. and a pressure of about 100 to 300 bar (flow b in FIG. 4) and BOG having passed through the first decompressor 710 and having a temperature of about −140° C. to −110° C. and a pressure of about 6 to 20 bar (flow c in FIG. 4). The BOG discharged from the storage tank 100 (flow a in FIG. 4) is compressed together with the BOG having passed through the first decompressor 710 (flow c in FIG. 4) by the multistage compressor 200 and is used as a refrigerant for cooling the BOG sent to the self-heat exchanger 410 (flow b in FIG. 4).

The BOG discharged from the storage tank 100 and having passed through the self-heat exchanger 410 is subjected to multistage compression by the multistage compressor 200, as in the ship including the high-pressure engine shown in FIG. 3.

Unlike the ship shown in FIG. 2, the ship including the low-pressure engine according to this embodiment includes a single multistage compressor, thereby enabling easy maintenance and overhaul.

However, according to this embodiment, all of the BOG compressed to the critical pressure or more through multistage compression by the multistage compressor 200 is sent to the self-heat exchanger 410, unlike the ship including the high-pressure engine shown in FIG. 3, in which some of the BOG compressed to the critical pressure or more by the multistage compressor 200 is sent thereto.

According to this embodiment, since some of the BOG having passed through the multistage compressor 200 is not directly sent to the engine, there is no need for the multistage compressor 200 to compress the BOG to a pressure required for the engine, unlike the ship including the high-pressure engine shown in FIG. 3. However, for reliquefaction efficiency, the BOG is preferably compressed to the critical pressure or more, more preferably 100 bar or more, by the multistage compressor 200. The BOG having passed through the multistage compressor 200 may have a temperature of about 40° C. to 50° C. and a pressure of about 100 to 300 bar.

The BOG compressed by the multistage compressor 200 and having passed through the self-heat exchanger 410 (flow b in FIG. 4) is divided into two flows, one of which is expanded by the first decompressor 710 and the other of which is expanded by the second decompressor 720, as in the ship including the high-pressure engine shown in FIG. 3. The BOG compressed by the multistage compressor 200 and having passed through the self-heat exchanger 410 may have a temperature of about −130° C. to −90° C. and a pressure of about 100 to 300 bar.

The BOG expanded by the first decompressor 710 after passing through the self-heat exchanger 410 (flow c in FIG. 4) is sent again to the self-heat exchanger 410 to be used as a refrigerant for cooling the BOG having passed through the multistage compressor 200 (flow b in FIG. 4) through heat exchange, as in the ship including the high-pressure engine shown in FIG. 3.

In this embodiment, however, the BOG subjected to heat exchange in the self-heat exchanger 410 after being expanded by the first decompressor 710 may be sent not only to the generator but also to the low-pressure engine, unlike the ship including the high-pressure engine shown in FIG. 3.

The BOG expanded by the first decompressor 710 after passing through the self-heat exchanger 410 may have a temperature of about −140° C. to −110° C. and a pressure of about 6 to 20 bar. Here, when the low-pressure engine is a gas turbine, the BOG expanded by the first decompressor 710 after passing through the self-heat exchanger 410 may have a pressure of about 55 bar.

Since the BOG expanded by the first decompressor 710 is sent to the low-pressure engine and/or the generator, the BOG is expanded to a pressure required for the low-pressure engine and/or the generator. In addition, the BOG having passed through the first decompressor 710 may have a gas-liquid mixed phase.

The BOG having passed through the self-heat exchanger 410 after being expanded by the first decompressor 710 may have a temperature of about −90° C. to 40° C. and a pressure of about 6 to 20 bar, and the BOG having passed through the first decompressor 710 may become a gas phase through heat exchange in the self-heat exchanger 410. Here, when the low-pressure engine is a gas turbine, the BOG having passed through the self-heat exchanger 410 after being expanded by the first decompressor 710 may have a pressure of about 55 bar.

The BOG sent to the generator after having passed through the first decompressor 710 and the self-heat exchanger 410 may be controlled to a temperature required for the generator by the heater 800, as in the ship including the high-pressure engine shown in FIG. 3. The BOG having passed through the heater 800 may have a temperature of about 40° C. to 50° C. and a pressure of about 6 to 20 bar. Here, when the low-pressure engine is a gas turbine, the BOG having passed through the heater 800 may have a pressure of about 55 bar.

The generator requires a pressure of about 6 to 10 bar and the low-pressure engine requires a pressure of about 6 to 20 bar. The low-pressure engine may be a DF engine, an X-DF engine, or a gas turbine. Here, when the low-pressure engine is a gas turbine, the gas turbine requires a pressure of about 55 bar.

The BOG expanded by the second decompressor 720 after having passed through the self-heat exchanger 410 may have a temperature of about −140° C. to −110° C. and a pressure of about 2 to 10 bar, as in the ship including the high-pressure engine shown in FIG. 3. In addition, the BOG having passed through the second decompressor 720 is partially reliquefied, as in the ship including the high-pressure engine shown in FIG. 3. The BOG partially reliquefied in the second decompressor 720 may be sent in a gas-liquid mixed phase to the storage tank 100 or may be sent to the gas/liquid separator 500, by which the gas-liquid mixed phase is separated into a liquid phase and a gas phase, as in the ship including the high-pressure engine shown in FIG. 3.

As in the ship including the high-pressure engine shown in FIG. 3, when the partially reliquefied BOG is sent to the gas/liquid separator 500, the liquefied natural gas separated by the gas/liquid separator 500 and having a temperature of about −163° C. and atmospheric pressure is sent to the storage tank 100, and the gaseous BOG separated by the gas/liquid separator 500 and having a temperature of about −160° C. to −110° C. and atmospheric pressure is sent together with the BOG discharged from the storage tank 100 to the self-heat exchanger 410. The flow amount of the BOG separated by the gas/liquid separator 500 and sent to the self-heat exchanger 410 may be controlled by the second valve 620.

FIG. 5 is a schematic diagram of a partial reliquefaction system applied to a ship including a high-pressure engine according to a second embodiment of the present invention.

The partial reliquefaction system applied to a ship including a high-pressure engine according to this embodiment is different from the partial reliquefaction system shown in FIG. 3 in that the self-heat exchanger 410 exchanges heat of two flows of fluid instead of three flows of fluid and the ship further includes another self-heat exchanger 420 adapted to exchange exchanges heat of two flows, and the following description will focus on different configuration of the partial reliquefaction system. Descriptions of details of the same components as those of the ship including the high-pressure engine described above will be omitted.

Referring to FIG. 5, as in the first embodiment shown in FIG. 3, the ship including the high-pressure engine according to this embodiment includes a self-heat exchanger 410, a multistage compressor 200, a first decompressor 710, and a second decompressor 720.

Unlike the ship of the first embodiment shown in FIG. 3, the ship according to this embodiment further includes a self-heat exchanger 420 performing heat exchange between BOG compressed by the multistage compressor 200 and BOG expanded by the first decompressor 710. Hereinafter, a self-heat exchanger for heat exchange between BOG discharged from the storage tank 100 and BOG compressed by the multistage compressor 200 will be referred to as a first self-heat exchanger 410 and a self-heat exchanger for heat exchange between the BOG compressed by the multistage compressor 200 and BOG expanded by the first decompressor 710 will be referred to as a second self-heat exchanger 420.

Unlike the self-heat exchanger 410 according to the first embodiment, which performs heat exchange between three flows, the first self-heat exchanger 410 according to this embodiment performs heat exchange between two flows and cools BOG L1 having passed through the multistage compressor 200 using BOG discharged from the storage tank 100 as a refrigerant.

When several flows of fluid are subjected to heat exchange in one heat exchanger, there can be a problem of deterioration in efficiency of heat exchange. However, in the ship including the high-pressure engine according to this embodiment, the partial reliquefaction system is configured to achieve substantially the same object as that of the first embodiment shown in FIG. 3 using a heat exchanger adapted to perform heat exchange between two flows of fluid, thereby providing more efficiency in heat exchange than the partial reliquefaction system according to the first embodiment.

As in the first embodiment shown in FIG. 3, the multistage compressor 200 according to this embodiment performs multistage compression with respect to BOG discharged from the storage tank 100 and having passed through the first self-heat exchanger 410, and may include a plurality of compression cylinders 210, 220, 230, 240, 250 and a plurality of coolers 310, 320, 330, 340, 350.

As in the first embodiment shown in FIG. 3, the first decompressor 710 expands some BOG subjected to multistage compression by the multistage compressor 200 and having passed through the first self-heat exchanger 410. However, unlike the first embodiment shown in FIG. 3, the first decompressor 710 according to this embodiment sends the expanded BOG to the second self-heat exchanger 420.

As in the first embodiment shown in FIG. 3, the partial reliquefaction system according to this embodiment sends the BOG expanded by the first decompressor 710 to the second self-heat exchanger 420 so as to be used as a refrigerant for heat exchange before being sent to the generator based on the fact that the BOG expanded to be sent to the generator is decreased not only in pressure but also in temperature. Thus, the ship according to this embodiment uses the BOG having passed through the first decompressor 710 as a refrigerant for additional heat exchange in the second self-heat exchanger 420, thereby improving reliquefaction efficiency.

According to this embodiment, the second self-heat exchanger 420 is disposed in parallel to the first self-heat exchanger 410 and cools BOG L2, which is divided from the BOG L1 having been compressed by the multistage compressor 200 and sent to the first self-heat exchanger 410, through heat exchange using the fluid having passed through the first decompressor 710 as a refrigerant.

As in the first embodiment shown in FIG. 3, the second decompressor 720 according to this embodiment expands the other BOG compressed by the multistage compressor 200 and having passed through the first self-heat exchanger 410. The fluid is partially or entirely reliquefied through compression by the multistage compressor 200, cooling by the first self-heat exchanger 410 or the second self-heat exchanger 420, and expansion by the second decompressor 720.

The first decompressor 710 and the second decompressor 720 may be an expansion device or an expansion valve.

The ship according to this embodiment may further include a gas/liquid separator 500 that separates gaseous BOG and liquefied natural gas generated by partial reliquefaction of the BOG having passed through the second decompressor 720. The liquefied natural gas separated by the gas/liquid separator 500 may be sent to the storage tank 100 and the gaseous BOG separated by the gas/liquid separator 500 may be sent to the line along which the BOG is sent from the storage tank 100 to the first self-heat exchanger 410.

In the structure wherein the ship according to this embodiment does not include the gas/liquid separator 500, the fluid partially or entirely reliquefied while passing through the second decompressor 720 may be directly sent to the storage tank 100.

The ship according to this embodiment may further include at least one of a first valve 610 controlling the flow amount of the BOG discharged from the storage tank 100 as needed; a third valve 630 disposed upstream of the first self-heat exchanger 410 and controlling the flow amount of the BOG L1 compressed by the multistage compressor 200 and sent to the first self-heat exchanger 410; and a fourth valve 640 disposed upstream of the second self-heat exchanger 420 and controlling the flow amount of the BOG L2 compressed by the multistage compressor 200 and sent to the second self-heat exchanger 420. The first valve 610 may be normally maintained in an open state and may be closed upon maintenance or overhaul of the storage tank 100.

The ship according to this embodiment may further include a heater 800 that heats the BOG sent to the generator through the first decompressor 710 and the second self-heat exchanger 420.

In the structure wherein the ship includes the gas/liquid separator 500, the ship may further include a second valve 620 that controls the flow amount of the gaseous BOG separated by the gas/liquid separator 500 and sent to the first self-heat exchanger 410.

The following description will be given of the flow of fluid in the structure wherein the ship including the high-pressure engine according to this embodiment includes the gas/liquid separator 500 and the heater 800.

BOG generated due to intrusion of external heat inside the storage tank 100 is discharged from the storage tank 100 and is then sent to the first self-heat exchanger 410 after being mixed with BOG separated by the gas/liquid separator 500, when the pressure of the BOG reaches a predetermined pressure or more. The BOG discharged from the storage tank 100 and sent to the first self-heat exchanger 410 is compressed by the multistage compressor 200 to be used as a refrigerant for cooling BOG to be supplied to the first self-heat exchanger 410 through heat exchange.

The BOG discharged from the storage tank 100 and having passed through the first self-heat exchanger 410 is sent to the multistage compressor 200, in which the BOG is compressed to a predetermined pressure or more required for the high-pressure engine through multistage compression. Compression of the BOG to a predetermined pressure or more required for the high-pressure engine through multistage compression by the multistage compressor 200 is performed to improve efficiency in heat exchange in the first self-heat exchanger 410 and the second self-heat exchanger 420, and a decompressor (not shown) is disposed upstream of the high-pressure engine and decompresses the BOG to a pressure for the high-pressure engine before the BOG is supplied to the high-pressure engine.

Among BOG compressed by the multistage compressor 200, some BOG is sent to the high-pressure engine, other BOG L1 is sent to the first self-heat exchanger 410, and the remaining BOG L2 is divided from the BOG L1 and sent to the second self-heat exchanger 420.

The BOG compressed by the multistage compressor 200 and sent to the first self-heat exchanger 410 is cooled through heat exchange with a flow, in which the BOG discharged from the storage tank 100 is joined with the BOG separated by the gas/liquid separator 500, as a refrigerant, and is then joined with the fluid L2 having passed through the multistage compressor 200 and the second self-heat exchanger 420.

The BOG compressed by the multistage compressor 200 and sent to the second self-heat exchanger 420 is cooled through heat exchange with the fluid expanded by a first decompressor 710 as a refrigerant, and is then joined with the fluid L1 having passed through the multistage compressor 200 and the first self-heat exchanger 410.

Some of the flow, in which the fluid cooled by the first self-heat exchanger 410 is joined with the fluid cooled by the second self-heat exchanger 420, is sent to the first decompressor 710 and the other flow is sent to the second decompressor 720.

The fluid cooled by the first self-heat exchanger 410 or the second self-heat exchanger 420 and sent to the first decompressor 710 may be decompressed to a pressure for the low-pressure engine by the first decompressor 710, and the fluid decompressed to have a lower pressure and temperature by the first decompressor 710 may be sent to the second self-heat exchanger 420 to be used as a refrigerant for cooling the BOG compressed by the multistage compressor 200. The fluid having passed through the first decompressor 710 and the second self-heat exchanger 420 is heated to a temperature required for the generator by the heater 800 and is then sent to the generator.

The fluid cooled by the first self-heat exchanger 410 or the second self-heat exchanger 420 and sent to the second decompressor 720 is partially reliquefied through expansion by the second decompressor 720 and is then sent to the gas/liquid separator 500.

The fluid sent to the gas/liquid separator 500 through the second decompressor 720 is separated into liquefied natural gas generated through partial reliquefaction and gaseous BOG by the gas/liquid separator 500, in which the reliquefied natural gas separated by the gas/liquid separator 500 is sent to the storage tank 100 and the gaseous BOG separated by the gas/liquid separator 500 is joined with BOG discharged from the storage tank 100 and is then sent to the first self-heat exchanger 410.

FIG. 6 is a schematic diagram of the partial reliquefaction system applied to a ship including a low-pressure engine according to the second embodiment of the present invention.

The partial reliquefaction system applied to the ship including the low-pressure engine shown in FIG. 6 is different from the partial reliquefaction system applied to the ship including the high-pressure engine shown in FIG. 5 in that some BOG subjected to multistage compression by the multistage compressor 200 is sent to the generator and/or the engine after having passed through the first decompressor 710 and the second self-heat exchanger 420, and the following description will focus on different configurations of the partial reliquefaction system according to this embodiment. Descriptions of details of the same components as those of the ship including the high-pressure engine shown in FIG. 5 will be omitted.

Referring to FIG. 6, as in the ship including the high-pressure engine shown in FIG. 5, the ship according to this embodiment includes a first self-heat exchanger 410, a second self-heat exchanger 420, a multistage compressor 200, a first decompressor 710, and a second decompressor 720.

As in the ship including the high-pressure engine shown in FIG. 5, the first self-heat exchanger 410 is adapted to perform heat exchange between two flows and cools BOG L1 having passed through the multistage compressor 200 using BOG discharged from the storage tank 100 as a refrigerant.

In the ship according to this embodiment, the partial reliquefaction system is configured to achieve substantially the same object as that of the first embodiment shown in FIG. 4 using a heat exchanger adapted to perform heat exchange between two flows of fluid, thereby providing more efficiency in heat exchange than the partial reliquefaction system according to the first embodiment.

As in the ship including the high-pressure engine shown in FIG. 5, the multistage compressor 200 according to this embodiment performs multistage compression with respect to BOG discharged from the storage tank 100 and having passed through the first self-heat exchanger 410, and may include a plurality of compression cylinders 210, 220, 230, 240, 250 and a plurality of coolers 310, 320, 330, 340, 350.

As in the ship including the high-pressure engine shown in FIG. 5, the first decompressor 710 according to this embodiment expands some BOG subjected to multistage compression by the multistage compressor 200 and having passed through the first self-heat exchanger 410. The fluid expanded by the first decompressor 710 is sent to the second self-heat exchanger 420.

As in the ship including the high-pressure engine shown in FIG. 5, the partial reliquefaction system according to this embodiment sends the BOG expanded by the first decompressor 710 to the second self-heat exchanger 420 so as to be used as a refrigerant for heat exchange before being sent to the generator based on the fact that the BOG expanded to be sent to the generator is decreased not only in pressure but also in temperature. Thus, the ship according to this embodiment uses the BOG having passed through the first decompressor 710 as a refrigerant for additional heat exchange in the second self-heat exchanger 420, thereby improving reliquefaction efficiency.

As in the ship including the high-pressure engine shown in FIG. 5, the second self-heat exchanger 420 according to this embodiment is disposed in parallel to the first self-heat exchanger 410 and cools BOG L2, which is divided from the BOG L1 having been compressed by the multistage compressor 200 and sent to the first self-heat exchanger 410, through heat exchange using the fluid having passed through the first decompressor 710 as a refrigerant.

As in the ship including the high-pressure engine shown in FIG. 5, the second decompressor 720 according to this embodiment expands the other BOG compressed by the multistage compressor 200 and having passed through the first self-heat exchanger 410. The fluid is partially or entirely reliquefied through compression by the multistage compressor 200, cooling by the first self-heat exchanger 410 or the second self-heat exchanger 420, and expansion by the second decompressor 720.

The first decompressor 710 and the second decompressor 720 may be an expansion device or an expansion valve.

As in the ship including the high-pressure engine shown in FIG. 5, the ship according to this embodiment may further include a gas/liquid separator 500 that separates gaseous BOG and liquefied natural gas generated by partial reliquefaction of the BOG having passed through the second decompressor 720. The liquefied natural gas separated by the gas/liquid separator 500 may be sent to the storage tank 100 and the gaseous BOG separated by the gas/liquid separator 500 may be sent to the line along which the BOG is sent from the storage tank 100 to the first self-heat exchanger 410.

In the structure wherein the ship according to this embodiment does not include the gas/liquid separator 500, the fluid partially or entirely reliquefied while passing through the second decompressor 720 may be directly sent to the storage tank 100, as in the ship including the high-pressure engine shown in FIG. 5.

As in the ship including the high-pressure engine shown in FIG. 5, the ship according to this embodiment may further include at least one of a first valve 610 controlling the flow amount of the BOG discharged from the storage tank 100 as needed; a third valve 630 disposed upstream of the first self-heat exchanger 410 and controlling the flow amount of the BOG L1 compressed by the multistage compressor 200 and sent to the first self-heat exchanger 410; and a fourth valve 640 disposed upstream of the second self-heat exchanger 420 and controlling the flow amount of the BOG L2 compressed by the multistage compressor 200 and sent to the second self-heat exchanger 420. The first valve 610 may be normally maintained in an open state and may be closed upon maintenance or overhaul of the storage tank 100.

As in the ship including the high-pressure engine shown in FIG. 5, the ship according to this embodiment may further include a heater 800 heating the BOG sent to the generator through the first decompressor 710 and the second self-heat exchanger 420.

In the structure wherein the ship includes the gas/liquid separator 500, the ship may further include a second valve 620 that controls the flow amount of the gaseous BOG separated by the gas/liquid separator 500 and sent to the first self-heat exchanger 410, as in the ship including the high-pressure engine shown in FIG. 5.

The following description will be given of the flow of fluid in the structure wherein the ship including the low-pressure engine according to this embodiment includes the gas/liquid separator 500 and the heater 800.

As in the ship including the high-pressure engine shown in FIG. 5, BOG generated due to intrusion of external heat inside the storage tank 100 is discharged from the storage tank 100 and is then sent to the first self-heat exchanger 410 after being mixed with BOG separated by the gas/liquid separator 500, when the pressure of the BOG reaches a predetermined pressure or more. As in the ship including the high-pressure engine shown in FIG. 5, the BOG discharged from the storage tank 100 and sent to the first self-heat exchanger 410 is compressed by the multistage compressor 200 to be used as a refrigerant for cooling BOG to be supplied to the first self-heat exchanger 410 through heat exchange.

As in the ship including the high-pressure engine shown in FIG. 5, the BOG discharged from the storage tank 100 and having passed through the first self-heat exchanger 410 is sent to the multistage compressor 200. The multistage compressor 200 compresses the BOG to a higher pressure than the pressure required for the low-pressure engine or the generator in order to improve efficiency in heat exchange in the first self-heat exchanger 410 and the second self-heat exchanger 420.

Among the BOG compressed by the multistage compressor 200, some BOG L1 is sent to the first self-heat exchanger 410, and the other BOG L2 is divided from the BOG L1 and sent to the second self-heat exchanger 420.

As in the ship including the high-pressure engine shown in FIG. 5, the BOG compressed by the multistage compressor 200 and sent to the first self-heat exchanger 410 is cooled through heat exchange with a flow, in which the BOG discharged from the storage tank 100 is joined with the BOG separated by the gas/liquid separator 500, as a refrigerant, and is then joined with the fluid L2 having passed through the multistage compressor 200 and the second self-heat exchanger 420.

As in the ship including the high-pressure engine shown in FIG. 5, the BOG compressed by the multistage compressor 200 and sent to the second self-heat exchanger 420 is cooled through heat exchange with the fluid expanded by the first decompressor 710 as a refrigerant, and is then joined with the fluid L1 having passed through the multistage compressor 200 and the first self-heat exchanger 410.

As in the ship including the high-pressure engine shown in FIG. 5, some of the flow, in which the fluid cooled by the first self-heat exchanger 410 is joined with the fluid cooled by the second self-heat exchanger 420, is sent to the first decompressor 710 and the other flow is sent to the second decompressor 720.

As in the ship including the high-pressure engine shown in FIG. 5, the fluid cooled by the first self-heat exchanger 410 or the second self-heat exchanger 420 and sent to the first decompressor 710 may be decompressed to a pressure for the low-pressure engine by the first decompressor 710, and the fluid decompressed to have a lower pressure and temperature by the first decompressor 710 is sent to the second self-heat exchanger 420 to be used as a refrigerant for cooling the BOG compressed by the multistage compressor 200. The fluid having passed through the first decompressor 710 and the second self-heat exchanger 420 is heated to a temperature required for the generator by the heater 800 and is then sent to the generator.

As in the ship including the high-pressure engine shown in FIG. 5, the fluid cooled by the first self-heat exchanger 410 or the second self-heat exchanger 420 and sent to the second decompressor 720 is partially reliquefied through expansion by the second decompressor 720 and is then sent to the gas/liquid separator 500.

As in the ship including the high-pressure engine shown in FIG. 5, the fluid sent to the gas/liquid separator 500 through the second decompressor 720 is separated into liquefied natural gas generated through partial reliquefaction and gaseous BOG by the gas/liquid separator 500, in which the reliquefied natural gas separated by the gas/liquid separator 500 is sent to the storage tank 100 and the gaseous BOG separated by the gas/liquid separator 500 is joined with BOG discharged from the storage tank 100 and is then sent to the first self-heat exchanger 410.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

The invention claimed is:

1. A ship including an engine, the ship comprising:

a first self-heat exchanger performing heat exchange with respect to boil-off gas (BOG) discharged from a storage tank;

a multistage compressor performing multistage compression of the BOG discharged from the storage tank and having passed through the first self-heat exchanger;

a first decompressor expanding a first portion of the BOG having passed through the first self-heat exchanger after compression by the multistage compressor;

a second decompressor expanding a second portion of the BOG having passed through the first self-heat exchanger after compression by the multistage compressor; and a second self-heat exchanger cooling some of the BOG compressed by the multistage compressor through heat exchange using the fluid expanded by the first decompressor as a refrigerant, a line sending the BOG having passed through the first decompressor and the second self-heat exchanger to at least one of a generator and a low-pressure engine; and a heater disposed on the line, wherein the first self-heat exchanger cools the other BOG compressed by the multistage compressor using the BOG discharged from the storage tank as a refrigerant.

2. The ship according to claim 1, wherein the second portion of the BOG expanded by the second decompressor is sent to the storage tank.

3. The ship according to claim 1, further comprising:

a gas/liquid separator disposed downstream of the second decompressor and separating liquefied gas generated through reliquefication of the second portion of the BOG, and gaseous BOG, from each other, wherein the liquefied gas separated by the second gas/liquid separator is sent to the storage tank and the gaseous BOG separated by the second gas/liquid separator is sent to the first self-heat exchanger.

4. The ship according to claim 1, wherein the first portion of the BOG after compression by the multistage compressor is sent to a high-pressure engine.

5. A method comprising:

1) performing multistage compression with respect to boil-off gas (BOG) discharged from a storage tank;

2) cooling a first portion of the BOG after the multistage compression through heat exchange with the BOG discharged from the storage tank;

3) cooling a second portion of the BOG after the multistage compression through heat exchange with a fluid expanded by a first decompressor, 4) joining the first portion of the BOG cooled in step 2) with the second portion of the BOG cooled in step 3) to provide a combined fluid;

5) reliquefying a first portion of the combined fluid joined in step 4) through expansion by a second decompressor;

6) using a second portion of the combined fluid joined in step 4) as a refrigerant in step 3) after expansion by the first decompressor;

7) heating, by a heater, the second portion of the combined fluid expanded by the first compressor and having been used as a refrigerant for exchange step 6); and 8) sending the fluid heated by the heater to at least one of a generator and a low-pressure engine.

6. The method according to claim 5, further comprising:

9) separating gaseous BOG and liquefied gas generated through partial reliquefaction of the second portion of the combined fluid expanded in step 6) from each other; and 10) sending the liquefied gas separated in step 9) to the storage tank and joining the gaseous BOG gas separated in step 9) with the BOG discharged from the storage tank to be used as a refrigerant for heat exchange in step 2).

7. The method according to claim 5, wherein some of the BOG after the multistage compression in step 1) is sent to a high-pressure engine.

8. The method according to claim 6, wherein some of the BOG after the multistage compression in step 1) is sent to a high-pressure engine.

* * * * *